US008677697B2

(12) United States Patent
Eklund et al.

(10) Patent No.: US 8,677,697 B2
(45) Date of Patent: Mar. 25, 2014

(54) LIFTING ANCHOR FOR A CONCRETE SLAB

(75) Inventors: Wesley K. Eklund, Muskegon, MI (US); Sidney E. Francies, III, Lithia, FL (US)

(73) Assignee: Sidney E. Francies, Lithia, FL (US)

( * ) Notice: Subject to any disclaimer, the term of this patent is extended or adjusted under 35 U.S.C. 154(b) by 0 days.

(21) Appl. No.: 13/414,757

(22) Filed: Mar. 8, 2012

(65) Prior Publication Data

US 2012/0227335 A1 Sep. 13, 2012

Related U.S. Application Data

(60) Provisional application No. 61/450,380, filed on Mar. 8, 2011.

(51) Int. Cl.
*E04B 1/38* (2006.01)

(52) U.S. Cl.
USPC ..... 52/125.4; 52/125.2; 52/700; 52/715

(58) Field of Classification Search
USPC ..... 52/125.2–125.6, 126.3, 126.5, 700, 52/712–715
IPC ..... E04G 21/14
See application file for complete search history.

(56) References Cited

U.S. PATENT DOCUMENTS 1,491,571 A * 4/1924 Tomkinson et al. ..... 52/708
1,768,246 A * 6/1930 Gaddis ..... 52/708
1,880,709 A * 10/1932 Bitney ..... 52/700
1,922,479 A * 8/1933 Joslin ..... 52/701
1,948,093 A * 2/1934 Baird et al. ..... 52/707
2,133,134 A * 10/1938 Davis ..... 52/708
2,236,082 A * 3/1941 Wright ..... 52/700
2,886,370 A * 5/1959 Liebert ..... 294/89
3,188,696 A * 6/1965 Earhart ..... 52/241
3,416,821 A * 12/1968 Benno ..... 411/458
4,173,856 A * 11/1979 Fricker ..... 52/125.5
4,831,796 A * 5/1989 Ladduwahetty ..... 52/125.5
4,905,444 A * 3/1990 Semaan et al. ..... 52/710
5,697,725 A * 12/1997 Ballash et al. ..... 403/231
5,809,703 A * 9/1998 Kelly ..... 52/125.5
6,647,674 B1 * 11/2003 Lancelot et al. ..... 52/125.4
7,111,432 B2 * 9/2006 Hansort ..... 52/125.4
2003/0213206 A1 * 11/2003 Hansort ..... 52/698
2008/0196324 A1 * 8/2008 Mackay Sim ..... 52/125.4
2010/0058677 A1 * 3/2010 Arteon ..... 52/122.1

* cited by examiner

*Primary Examiner* — Adriana Figueroa
(74) *Attorney, Agent, or Firm* — McGarry Bair PC

(57) ABSTRACT

An anchor for embedment in a concrete slab to provide for the lifting of the slab comprises first and second elongate plates adapted to be arranged in facing relationship for form a composite anchor. Each of the first and second plates has a distal end and a proximate end and at one hole between the distal and proximate ends. The proximate end of each plate has a flange bent outwardly of the outer planer face thereof. The distal end of each plate has laterally projecting feet that are bent laterally of a planar face. The side edges of each of the plates have converging side edges that extend downwardly to the feet.

21 Claims, 8 Drawing Sheets

LIFTING ANCHOR FOR A CONCRETE SLAB

CROSS REFERENCE TO RELATED APPLICATION

This application claims the benefit of U.S. Provisional Patent Application No. 61/450,380, filed Mar. 8, 2011, which is incorporated herein by reference in its entirety.

BACKGROUND OF THE INVENTION

1. Field of the Invention

This invention relates to an anchor that is adapted to be embedded in a concrete slab to provide a lifting attachment for the slab. In one of its aspects, the invention relates to an anchor for lifting and moving a concrete slab. In another of its aspects, the invention relates to an anchor having a bent flange for providing a lifting attachment for a concrete slab. In another of its aspects, the invention relates to an anchor assembly which comprises a pair of anchor plates having bent flanges adapted to be arranged in facing relationship for forming the anchor assembly to provide a lifting attachment for a concrete slab.

2. Description of the Related Art

An anchor or multiple anchors are generally used in a field in which a precast concrete slab is lifted to move the slab from one position to another position. In some instances, anchors coupled to void assemblies are positioned in the outer portion of a mold space in which wet concrete is poured and cured to form a concrete slab. The void assembly is then detached from the anchors to form a recess leaving an exposed portion of the anchors. The exposed portion of anchors typically has an opening that receives a shackle or other lifting component with a clutch ring or locking bolt.

U.S. Pat. No. 5,596,846 to Kelly discloses an anchor for embedment in a concrete slab to provide a lifting attachment for the member. The anchor comprises an elongate bar having convergent and divergent surfaces wherein the divergent surfaces face outwardly to direct axial pull-out forces imparted to the bar divergently and laterally into a concrete member within which the anchor is embedded. Divergent wings are fixed to and extend laterally from the bar to direct lateral forces imparted to the bar in divergent directions relative to the bar.

U.S. Pat. No. 3,883,170 to Fricker et al. discloses a lifting anchor for embedment in concrete members and a quick release hoisting shackle wherein the anchor takes the form of bars having split divergent ends or ends turned upon themselves to resist pull-out from the slab.

U.S. Pat. No. 4,173,856 to Fricker discloses an anchor element for the tilt-up and transport of prefabricated building components, and employs bars having split divergent ends to resist pull-out. One of the oppositely oriented force-transmitting surfaces engages a surface of the hoisting shackle body during tilt-up, thereby preventing pivoting of the shackle body against the concrete recess which surrounds the exposed portion of the anchor element.

U.S. Pat. No. 4,367,892 to Holt discloses anchors of a T-shaped configuration to resist pull-out and are generally formed by casting. The T-shaped anchors are supported by anchor support member made of plastics.

U.S. Pat. No. 4,580,378 to Kelly et al. discloses anchors that are stamped and embody a pin which extends transversely through the anchor to resist pull-out.

U.S. Pat. No. 4,930,269 to Kelly et al. discloses anchors that are formed of heavy wire stock which is bent into an inverted V-shaped configuration and has integrally formed laterally extending distal ends which are formed by bending and provide resistance to pull-out.

Anchors are typically made of bar stock which is strong but difficult to work. Three dimensional configurations, such as anchors with wing attachments, have several disadvantages. Anchors having three dimensional structures typically require more complicated manufacturing steps. For example, the anchors with wing attachments can require additional steps, such as welding of wing to the anchor bar. Additional manufacturing steps can also lead to the high manufacturing cost, which reduces productivity.

SUMMARY OF THE INVENTION

According to the invention, an lifting anchor for lifting of a concrete slab comprises a pair of first and second elongated plates, each of the first and second plates further having outer and inner planar faces bounded by a continuous edge. The first and second plates are arranged with the inner planar faces in facing relationship with each other and forming a composite anchor. Each of the first and second plates has a distal end and a proximate end, and at least one hole between the distal and proximate ends. The proximate end of each of the first and second plates has a flange bent outwardly of a planar face thereof. The distal end of each of the first and second plates having laterally projecting feet that have linear upper edges and lower edges, wherein the upper edges and lower edges form a part of the continuous edge. The continuous edge includes linear indented side edges at the distal end transversely intersecting the linear upper edges of the feet of each of the first and second plates.

In one embodiment, the laterally projecting feet are bent outwardly of one of the planar faces.

Further according to the invention, a lifting anchor for embodiment in a concrete slab to provide for the lifting of the slab comprises an elongated plate having a distal end and a proximate end and plurality of holes between the distal and proximate ends, the plate further having planar face surfaces bounded by a continuous edge. The proximate end has at least one flange bent outwardly of one of the planar faces thereof and the distal end has laterally projecting feet that have a linear upper edge and a lower edge, the linear upper edge and the lower edge forming a part of the continuous edge. The continuous edges of the elongated plate includes indented linear side edges at a distal end thereof and the linear side edges extend downwardly above the feet and transversely intersect the linear upper edges of the feet.

In one embodiment, the proximate end has two flanges that are bent outwardly from opposite sides of the planar faces. In another embodiment, the two flanges are bent in opposite directions with respect to the planar faces. In another embodiment, the two flanges are bent in the same direction with respect to the planar faces.

Further according to the invention, an anchor for embedment in a concrete slab to provide for the lifting of the slab comprises a pair of first and second elongated plates, each of the first and second plates having a distal end and a proximate end and plurality of holes between the distal and proximate ends, each of the first and second plates further having outer and inner planar faces bounded by a continuous edge, wherein the first and second plates are arranged with the inner planar faces in facing relationship with each other and forming a composite anchor. The proximate end of each of the first and second plates can have an integral flange extending from each side thereof and bent outwardly of the outer planar surface thereof. The distal end of each of the first and second plates can have laterally projecting feet that have a linear upper edge and a lower edge, wherein the linear upper edge and the lower edge can form a part of the continuous edge. The continuous edge can includes indented linear side edges at the distal end, and the linear side edges can extend downwardly above the feet of each of the first and second plates and can transversely intersect the linear upper edges of the feet.

In one embodiment, the indented linear side edges can be parallel to a longitudinal axis of the first and second plates.

In another embodiment, the first and second plates can be formed by stamping and bending from sheet metal plates having a thickness of ⅜".

In yet another embodiment, the flanges can be bent at an angle with respect to the outer_planar faces between 45 and 90 degrees.

DESCRIPTION OF AN EMBODIMENT OF THE INVENTION

Figure 1:
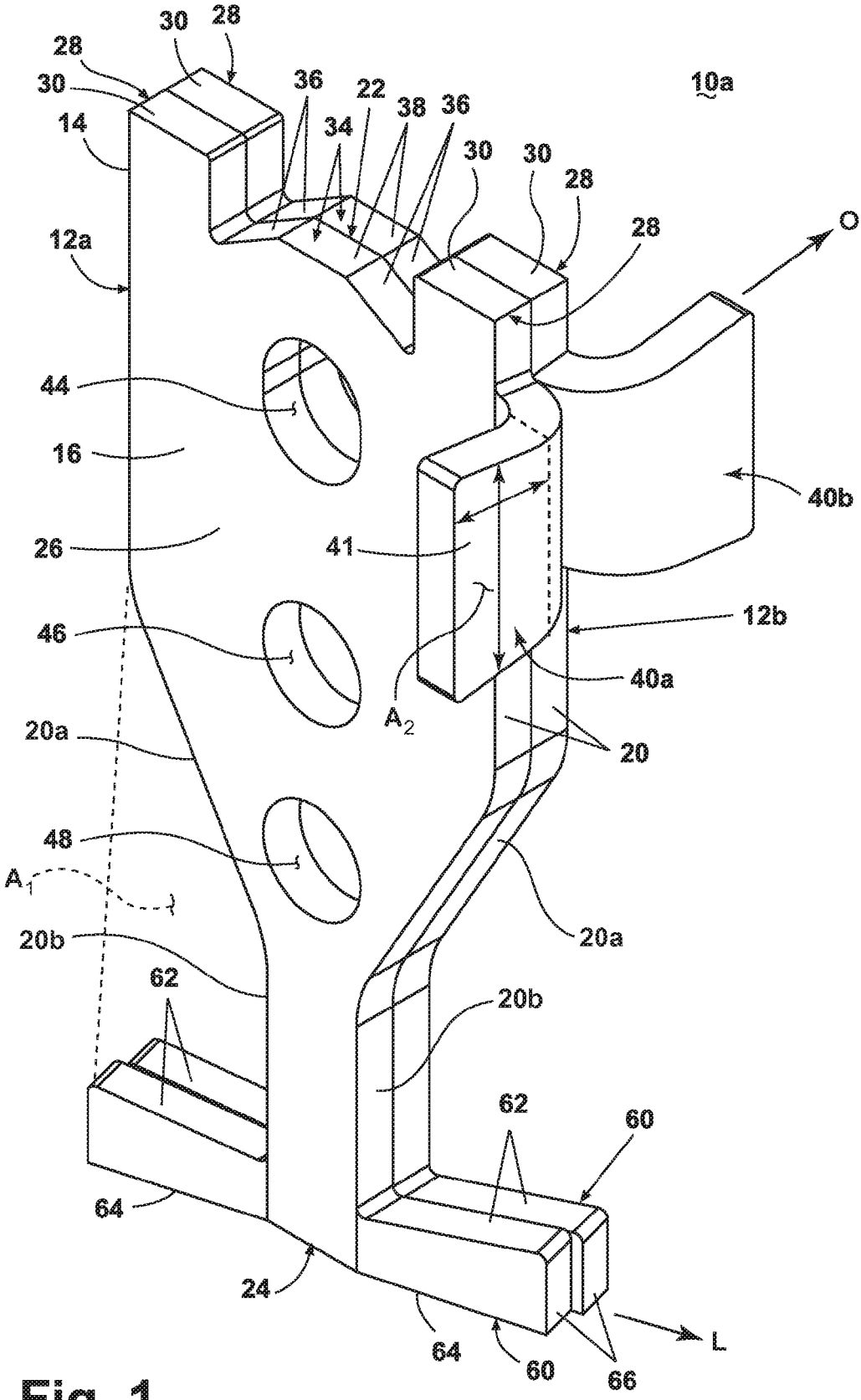
FIG. 1 is a front perspective view of an anchor assembly according to an embodiment of the invention, with a pair of 'twin' anchors are aligned in a facing relationship to lift and move at least one slab from one position to another position.
Figure 5:
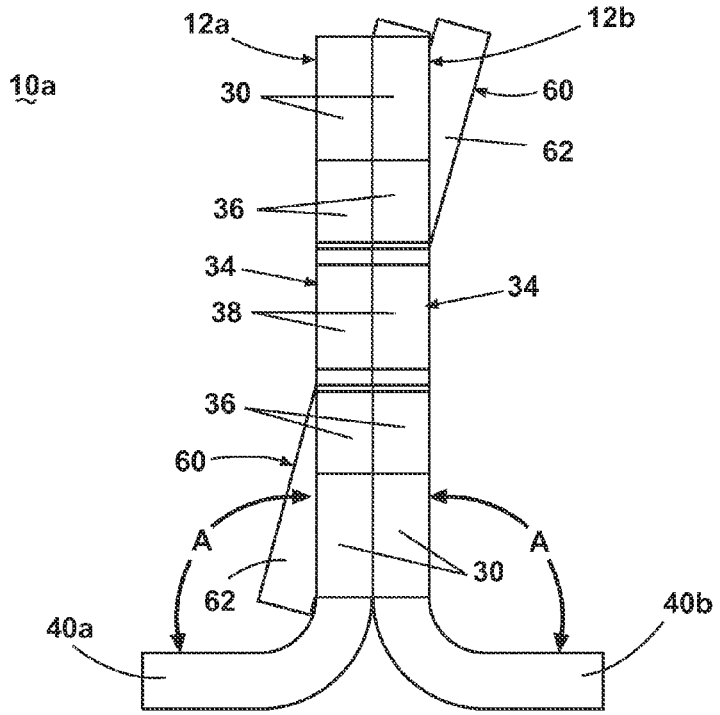
FIG. 5 is a top view of the anchor assembly of FIG. 1.
Figure 6:
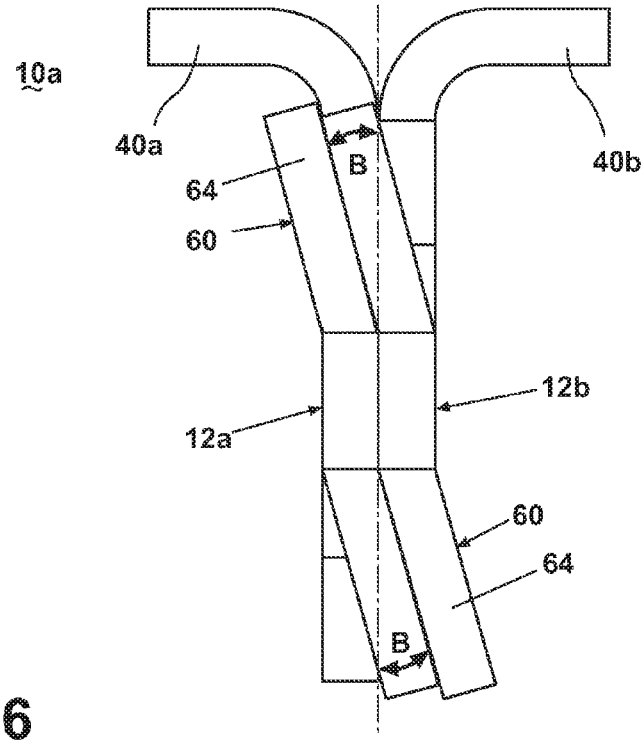
FIG. 6 is a bottom view of the anchor assembly of FIG. 1.
Figure 7:
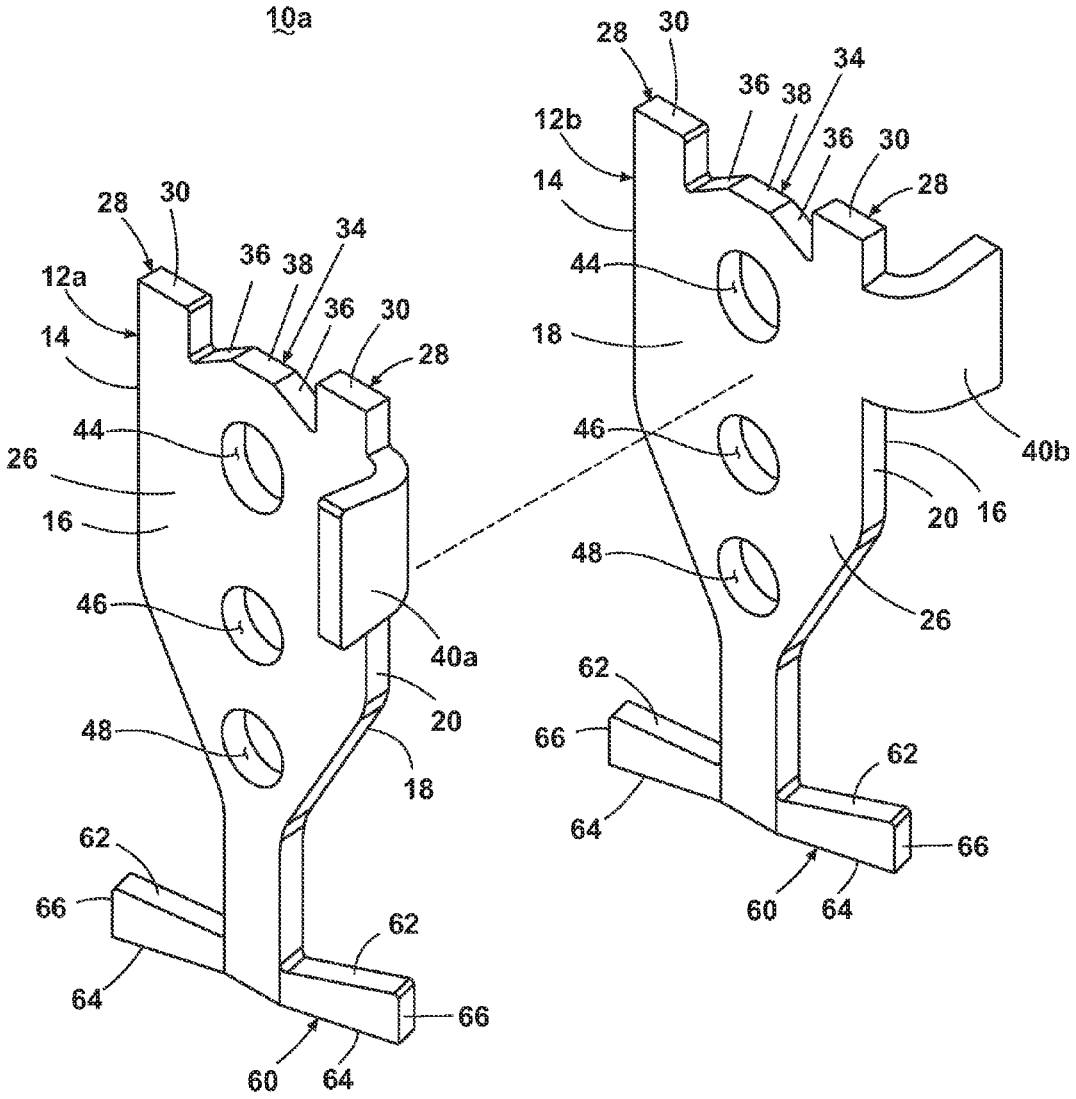
FIG. 7 is an exploded view of the anchor assembly of FIG. 1.

Referring to the drawings and FIGS. 1-7 in particular, an anchor assembly 10*a* is illustrated according to an embodiment of the invention. The anchor assembly 10*a* comprises a pair of the anchors 12*a*, 12*b* that are arranged in a facing relationship to form the anchor assembly 10*a* as illustrated in FIGS. 1 and 7. Each anchor 12*a*, 12*b* comprises a flat, elongated plate 14 having an outer planar face 16, an inner planar face 18, and a side edge 20 that abuts the outer planar face 16 and the inner planar face 18 to define a finite thickness (t) of the elongated plate 14.

The elongated plate 14 further comprises a proximate end 22 and a distal end 24, both of which are connected by a body 26 therebetween. The proximate end 22 includes a pair of upstanding ears 28 that are positioned to the outer edges of the proximate end 22. The upstanding ears 28 include angular extensions 30 one of which can be coupled to a portion of the shackle 32 that is operably coupled to the anchor assembly 10*a*, which will be described in detail in FIG. 10.

The central portion 34 is positioned between the pair of the upstanding ears 28, connected by downwardly sloping edge 36. The central portion 34 may include a flat area 38, and the height of the central portion 34 is typically lower than that of the upstanding ears 38.

Figure 2:
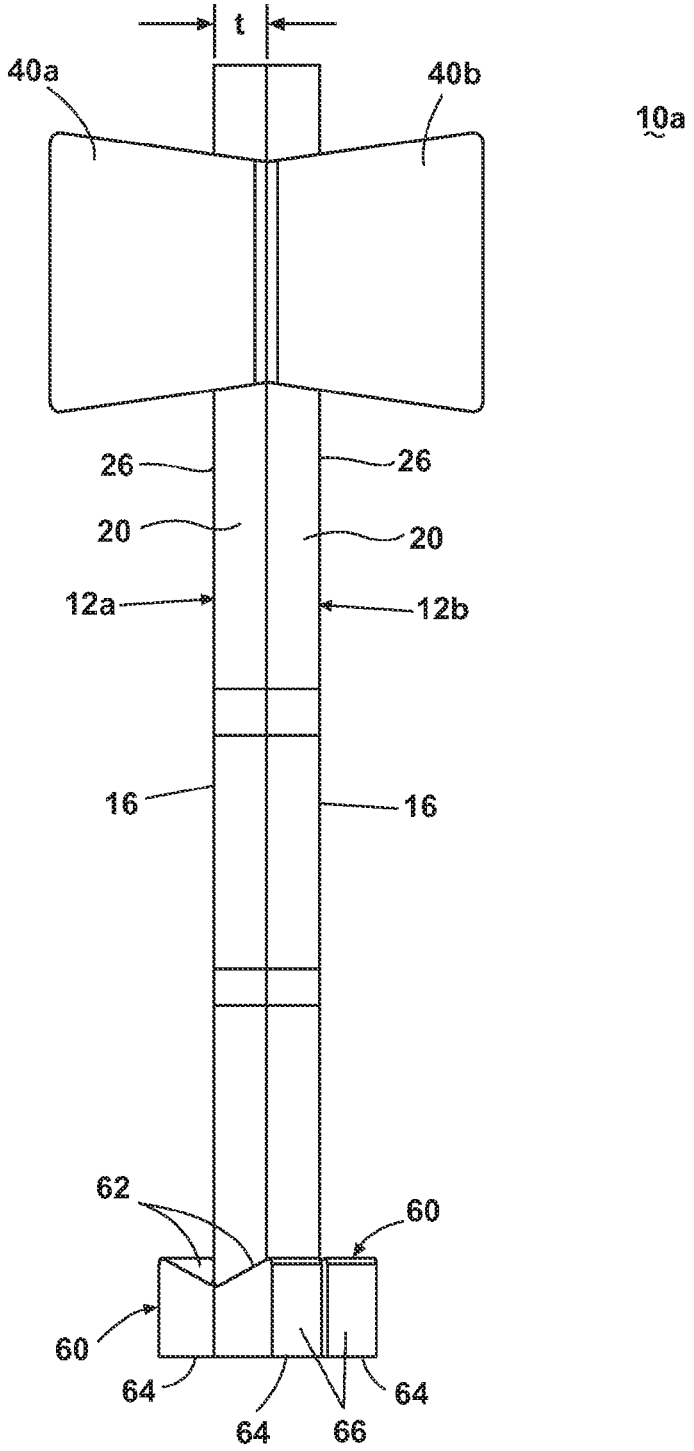
FIG. 2 is a right side view of the anchor assembly of FIG. 1.

The proximate end 22 further includes a flange 40*a*, 40*b* that is integrally formed with an upper portion of one side edge 20 of the elongated plate 14. The flange 40*a*, 40*b* is typically bent outwardly in the direction "O," along the line that is parallel to the longitudinal symmetry line 42 at an angle (A) to the planar faces 16, 18 between 45 and 90 degrees. For the anchor assembly 10*a*, one flange 40*a* in one anchor 12*a* can be bent in one direction while another flange 40*b* in another anchor 12*b* can be bent in the opposite direction, as illustrated in FIG. 2, such that the configuration of the flanges 40*a*, 40*b* of the anchor assembly 10*a* is symmetrical to the longitudinal axis of the anchor assembly 10*a*. Thus, the blanks that form anchors 12*a* and 12*b* are identical but for the flanges 40*a* and 40*b* which are bent in opposite directions. Thus, the blanks are initially identical prior to bending the flanges 40*a* and 40*b*.

Figure 3:
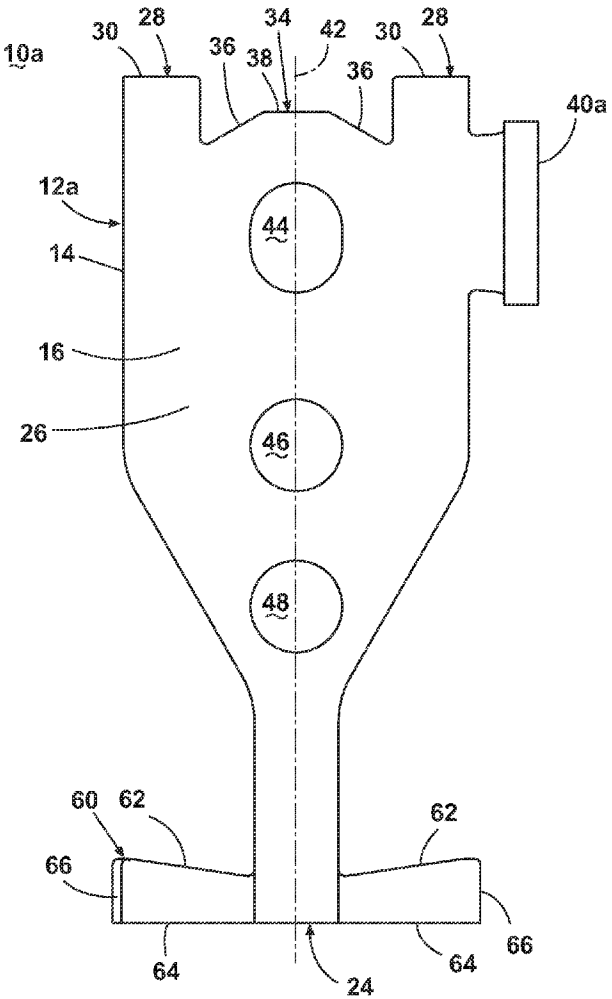
FIG. 3 is a front view of the anchor assembly of FIG. 1.

The body 26 of the elongated plate 14 includes a plurality of openings 44, 46, 48 each of which having predetermined shapes and dimensions. Typically the uppermost opening 44 which is nearest to the central portion 34 is configured to receive a locking bolt 50 through the uppermost opening 44. It is noted that three openings are illustrated in FIG. 3, while other configurations of openings are also possible, depending on the direction and magnitude of load of the slab that is lifted and moved. The openings 44, 46, 48 are typically aligned along a longitudinal symmetry line 42, and formed through the elongated plate 14 such that locking bolt 50 and reinforcement rods can be received through the openings 44, 46, 48, respectively.

The body 26 of the elongated plate 14 further includes side edges 20 that extend downward and merges with inwardly and downwardly extending edges 20*a* that extends toward the longitudinal symmetry line 42, and join indented linear (straight) side edges 20*b* that extend downwardly until the side edges 20*b* meet a pair of feet 60. The downwardly extending indented linear side edges 20*b* are parallel to the longitudinal symmetry line 42 and merge the converging portions 20*a* with the feet 60.

Figure 4:
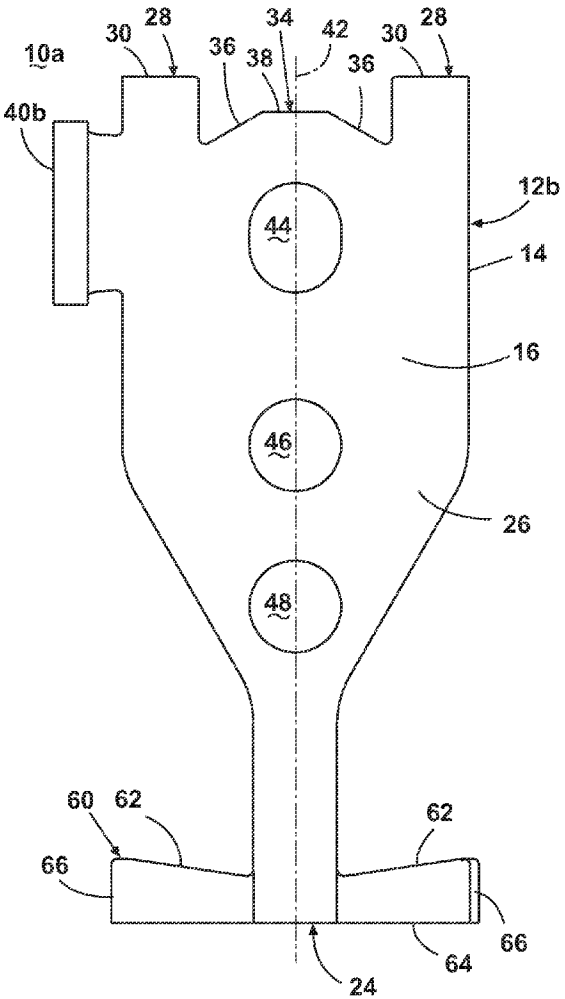
FIG. 4 is a rear view of the anchor assembly of FIG. 1.

The distal end 24 of the elongated plate 14 terminates at the feet 60 laterally projecting outwardly of the elongated plate 14. Each foot 60 includes a linear (straight) upper edge 62 and a linear lower edge 64 bounded by a side edge 66. As illustrated in FIGS. 3 and 4, the upper edge 62 and the lower edge 64 of each foot 60 can be parallel to each other while the upper edge 62 can be slanted with respect to the lower edge 64 of each foot 60. "The overall width of the feet 60 is configured to be equal to or greater than that of the elongated plate 14.

As further illustrated in FIGS. 5 and 6, one foot 60 of the anchors 12*a*, 12*b* is bent outwardly in one direction while the other foot of the anchor 12*a*, 12*b* is bent outwardly in another direction. The feet 60 are bent at an acute angle (B) with respect to the planar faces 16, 18, for example, between 5 and 25 degrees, typically at 15 degrees.

Figure 8:
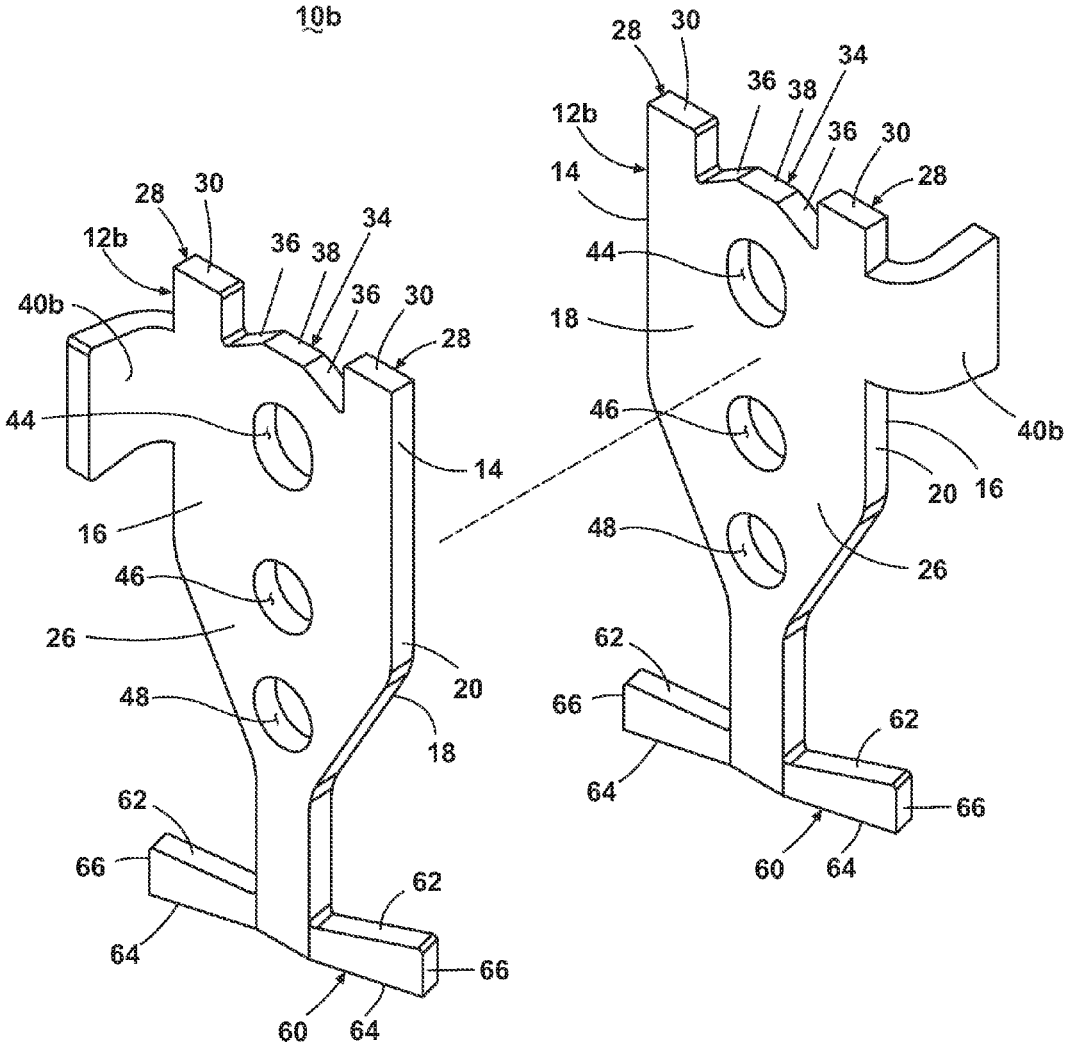
FIG. 8 is an exploded view of an anchor assembly according to another embodiment of the invention.

Referring to FIG. 8, anchor assemblies 10*b*, according to another embodiment is illustrated. The anchor assembly 10*b* in FIG. 8 comprises a pair of identical anchors 12*b* that are arranged in a facing relationship such that two flanges 40*b* face opposite direction. It is noted that, in addition to the embodiment in FIG. 8, each anchor 12*a* or 12*b* can be separately used in lifting a slab. It is also noted that the height of the flanges 40*b* in FIG. 8 can be different. For example, one flange 40*b* can extend from an upper portion of one side edge 20 while another flange 40*b* can extend from a lower portion of one side edge 20.

Figure 9:
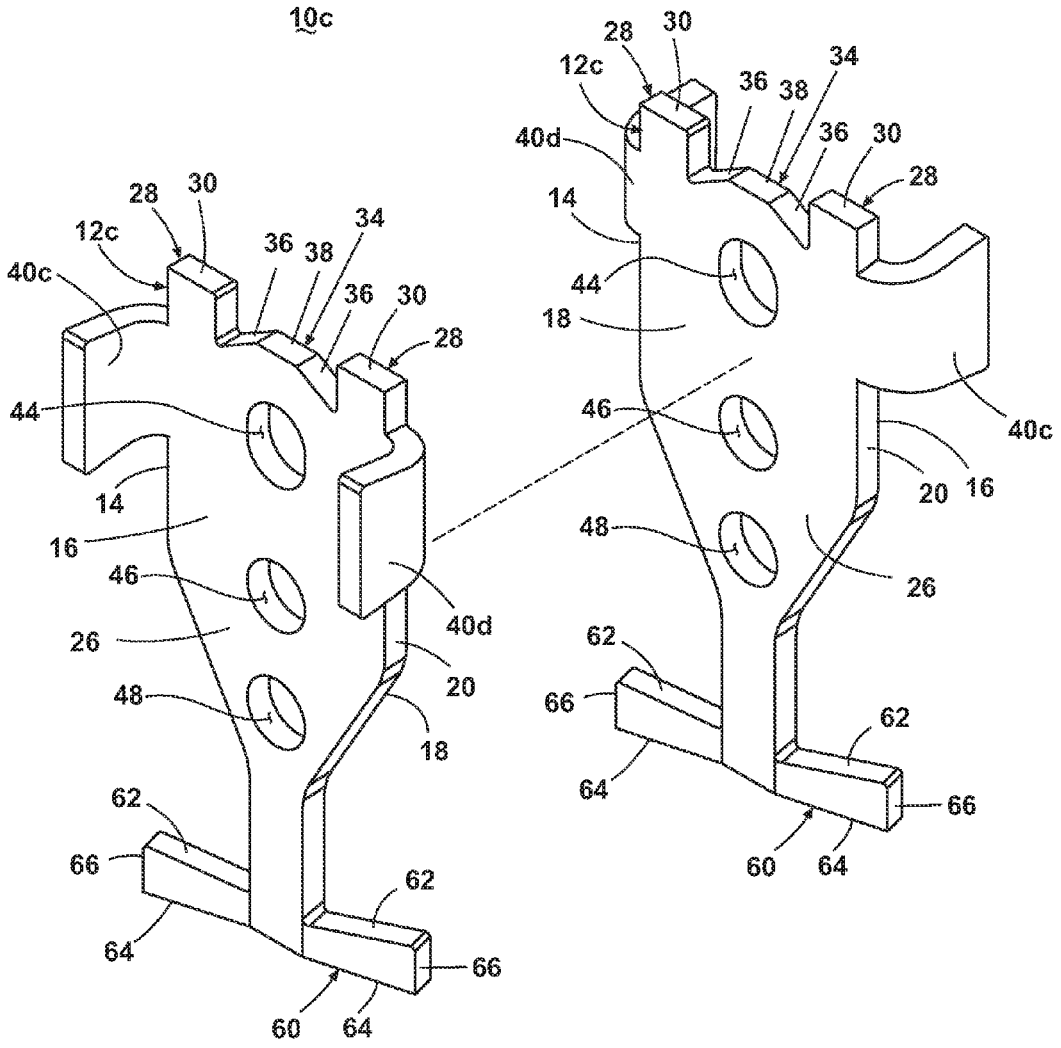
FIG. 9 is an exploded view of an anchor assembly according to yet another embodiment of the invention.

Similar to FIG. 8, the anchor assembly 10*c* in FIG. 9 comprises a pair of identical anchors 12*c* that are arranged in a facing relationship. Anchor 12*c* comprises two flanges 40*c*, 40*d* integrally formed with and extending from opposite side edges 20 of the elongated plate 14, instead only one flange

40*a*, 40*b* at one side edge 20 for anchors 12*a* and 12*b* as disclosed above. In addition, each anchor 12*c* can be separately used in lifting a slab.

Figure 10:
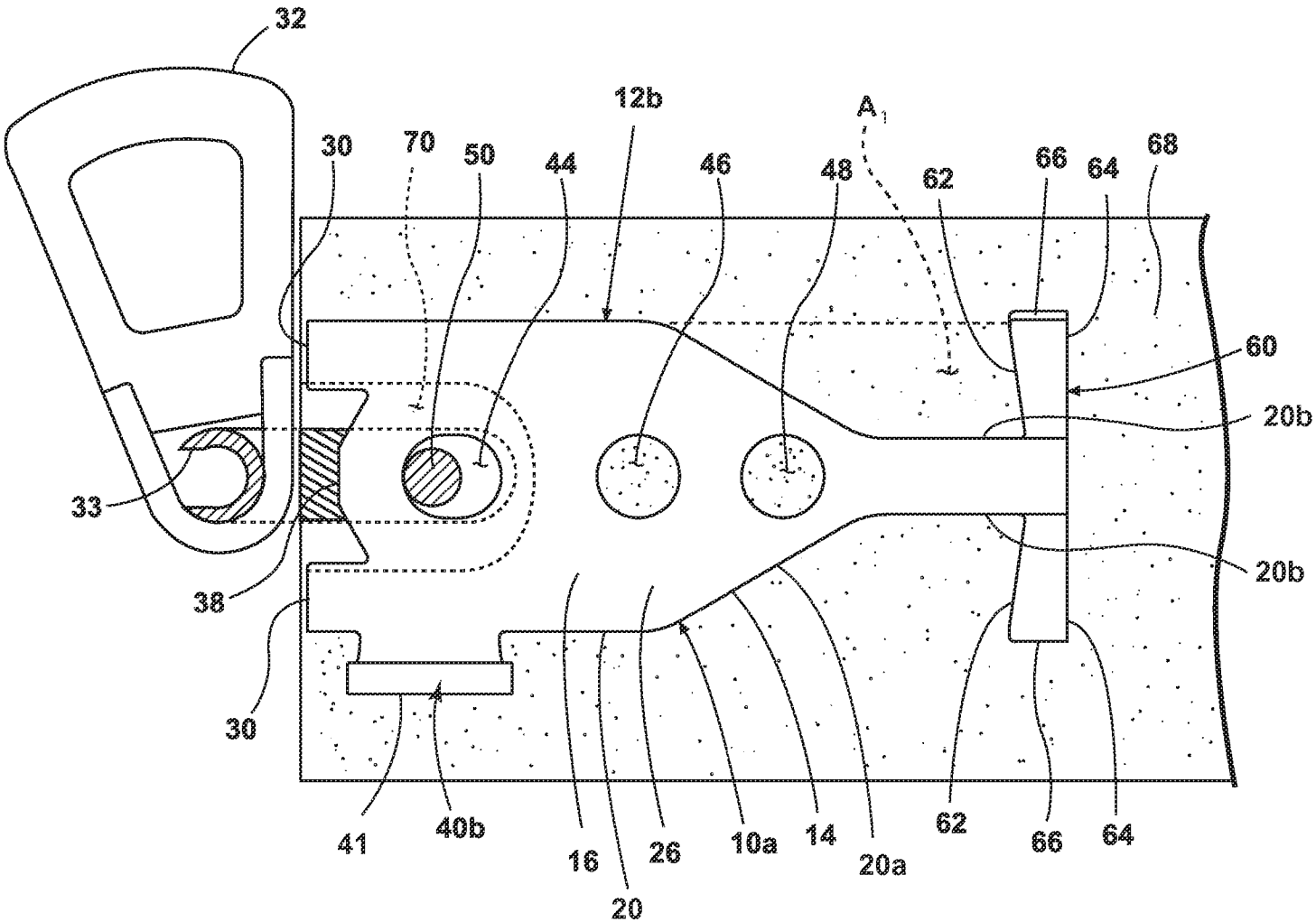
FIG. 10 is a side elevation view of the anchor assembly of FIG. 1 embedded in a concrete slab and a hoisting shackle connected to the anchor to tilt the slab upwardly.

Referring to FIG. 10, the anchor assembly 10*a* is embedded in a concrete slab 68 and connected to a hoisting shackle 32 that is coupled to the anchor assembly 10*a* to lift the concrete slab 68 upwardly. The anchor assembly 10*a* is embedded in the outer portion of the concrete slab 68 with flanges 40*a*, 40*b* toward the sides of the concrete slab 68. It is contemplated that a void assembly (not shown) having a void cap (not shown), coupled to the anchor assembly 10*a* prior to embedding in the concrete slab 68, is currently detached from the anchor assembly 10*a* to provide a recess 70.

As a result, only a small portion of the anchor assembly 10*a*, such as the opening 44 to receive the locking bolt 50, is exposed in the recess 70 while most of the anchor assembly 10*a* is embedded in the concrete slab 68. The locking bolt 50 with surrounding shackle cavity 33 is either manually or automatically coupled to the shackle 32, which is coupled to the connecting element (not shown). Additional tension bars (not shown) or rods may be received by at least one opening formed in the body 26 of elongated plate 14 of the anchor assembly 10*a* to further distribute lifting force applied to the concrete slab 68 to the anchor assembly 10*a*. It is also noted that the configuration of the feet 60 and flanges 40 that are bent in predetermined directions can provide resistance to the pull-out while the concrete slab 68 is lifted and moved.

The invention provides several advantages over prior art. The invention provides a simpler way of manufacturing anchors without adding additional steps. For example, unlike other anchors that may need a welding step during manufacturing, the invention can eventually provide the anchor assembly having three dimensional attachments using simple manufacturing steps such as metal stamping and bending processes.

Specifically, individual plates are initially subject to the stamping step where the plate is cut into a blank to satisfy both dimension and shape requirements. The stamping step is then followed by at least one punching step to form at least one opening in the plate. The pair of feet of the plate can then be bent according to the design using a stamping process. The final step of the manufacturing is to bend the flanges to form the individual anchor. The anchor manufacturing steps in the invention includes simple mechanical machine steps, and do not require any complex steps, such as welding of flange to the anchor. The plates are identically processed until the last bending step where one flange is bent in one direction while another flange is bent in an opposite direction. Even the flange bending step in opposite directions can be performed at the same time using one machine press.

This simple manufacturing of the anchor assembly would be partially due to the thickness of individual anchors that can be assembled in to the anchor assembly. Instead of thicker metal bars for conventional once piece anchors, thinner metal plates, for example, ⅜ in thick, can be used for the individual anchor having a bent flange, which makes it possible to adapt a simple manufacturing processes such as stamping and bending. As a result, the invention provides a way to lower overall manufacturing cost and at the same time increase the productivity.

Whereas the invention has been described with respect to the use of two blanks in back to back juxtaposition, any of the individual blanks can be used by itself as an anchor in a slab. In such case, perhaps the single anchors may need to be spaced closer to each other in the slab than pairs of anchors used as described above in facing juxtaposition.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An anchor for embedment in a concrete slab to provide for the lifting of the slab, the anchor comprising:

a pair of first and second elongated plates, each of the first and second plates having a distal end and a proximate end and plurality of holes between the distal and proximate ends, each of the first and second plates further having outer and inner planar faces bounded by a continuous edge, wherein the first and second plates are arranged with the inner planar faces in facing relationship with each other and forming a composite anchor;

the proximate end of each of the first and second plates having a flange bent outwardly of the outer planar surface thereof;

the distal end of each of the first and second plates having laterally projecting feet that have linear upper edges and lower edges, wherein the upper edges and lower edges form a part of the continuous edge; and the continuous edge includes linear indented side edges at the distal end transversely intersecting the linear upper edges of the feet of each of the first and second plates.

2. The anchor of claim 1 wherein at least one of the feet is bent outwardly of one of the planar faces.

3. The anchor of claim 2 wherein the at least one of the feet is bent at an acute angle with respect to one of the planar faces between 5 and 25 degrees.

4. The anchor of claim 1 wherein one of the feet is bent outwardly of one of the planar faces in a first direction and the other of the feet is bent outwardly of the other one of the planar faces in a second direction.

5. The anchor of claim 4 wherein the first and second directions are opposite to each other.

6. The anchor of claim 1 wherein the flanges are bent at an angle with respect to the planar faces between 45 and 90 degrees.

7. An anchor for embedment in a concrete slab to provide for the lifting of the slab, the anchor comprising:

an elongated plate having a distal end and a proximate end and plurality of holes between the distal and proximate ends, the plate further having planar faces bounded by a continuous edge;

the proximate end having at least one flange bent outwardly of a planar surface thereof;

the distal end of the elongated plate having laterally projecting feet that have a linear upper edge and a lower edge, wherein the linear upper edge and the lower edge form a part of the continuous edge; and the continuous edge of the elongated plate includes indented linear side edges at a distal end thereof, the linear side edges extending downwardly above the feet and transversely intersects the linear upper edges of the feet.

8. The anchor of claim 7 wherein at least one of the feet is bent outwardly of the planar faces.

9. The anchor of claim 7 wherein one of the feet is bent outwardly of the planar faces in a first direction and the other of the feet is bent outwardly of the planar faces in a second direction.

10. The anchor of claim 9 wherein the first and second directions are opposite to each other.

11. The anchor of claim 7 wherein the at least one flange is bent at an angle with respect to the planar faces between 45 and 90 degrees.

12. The anchor of claim 7 wherein the at least one flange comprises two flanges that are bent outwardly from opposite sides of the planar faces.

13. The anchor of claim 12 wherein the two flanges are bent in opposite directions with respect to the planar faces.

14. The anchor of claim 12 wherein the two flanges are bent in the same direction with respect to the planar faces.

15. The anchor of claim 7 wherein the at least one flange comprises two flanges that are bent outwardly from opposite sides of the planar faces and the flanges are bent at an angle with respect to the planar faces between 45 and 90 degrees.

16. An anchor for embedment in a concrete slab to provide for the lifting of the slab, the anchor comprising:

a pair of first and second elongated plates, each of the first and second plates having a distal end and a proximate end and plurality of holes between the distal and proximate ends, each of the first and second plates further having outer and inner planar faces bounded by a continuous edge, wherein the first and second plates are arranged with the inner planar faces in facing relationship with each other and forming a composite anchor;

the proximate end of each of the first and second plates having an integral flange extending from each side thereof and bent outwardly of the outer planar surface thereof;

the distal end of each of the first and second plates having laterally projecting feet that have a linear upper edge and a lower edge, wherein the linear upper edge and the lower edge form a part of the continuous edge; and the continuous edge includes indented linear side edges at the distal end, the linear side edges extending downwardly above the feet of each of the first and second plates and transversely intersecting the linear upper edges of the feet.

17. The anchor of claim 16 wherein the indented linear side edges are parallel to a longitudinal axis of the first and second plates.

18. The anchor of claim 16 wherein the first and second plates are formed by stamping and bending from sheet metal plates having a thickness of ⅜".

19. The anchor of claim 18 wherein the flanges are bent at an angle with respect to the outer planar faces between 45 and 90 degrees.

20. The anchor of claim 16 wherein the flanges are bent at an angle with respect to the outer planar faces between 45 and 90 degrees.

21. An anchor for embedment in a concrete slab to provide for the lifting of the slab, the anchor comprising:

a pair of first and second elongated plates, each of the first and second plates having a distal end and a proximate end and plurality of holes between the distal and proximate ends, each of the plates further having outer and inner planar faces bounded by a continuous edge, wherein the first and second plates are arranged with the inner planar faces in facing relationship with each other and forming a composite anchor;

the proximate end of each of the first and second plates has an integrally formed flange bent outwardly of the outer planar surface thereof;

the distal end of each of the first and second plates have laterally projecting feet that have linear upper edges and lower edges, wherein the linear upper edges and the linear lower edges form a part of the continuous edge; and the continuous edge at one side of each of the first and second plates has a linear edge that extends downwardly from the flange and joins an inwardly and downwardly extending linear edge that extends toward a longitudinal symmetry line of the respective one of the first and second plates to an indented linear edge that extends further downwardly to meet the upper edge of one of the feet, wherein the upper edge of the one of the feet, the indented linear edge and the inwardly and downwardly extending linear edge form a recessed open space.

* * * * *